US005868395A

United States Patent [19]

Headrick

[11] Patent Number: 5,868,395

[45] Date of Patent: Feb. 9, 1999

[54] DISC-CATCHING DEVICE

[75] Inventor: Edward Headrick, Watsonville, Calif.

[73] Assignee: Disc Golf Association, Inc., Watsonville, Calif.

[21] Appl. No.: 712,868

[22] Filed: Sep. 12, 1996

[51] Int. Cl.[6] ..... A63B 67/06

[52] U.S. Cl. ..... 273/400; 473/476

[58] Field of Search ..... 273/400, 398, 273/401; 473/476, 479

[56] References Cited

U.S. PATENT DOCUMENTS 4,039,189 8/1977 Headrick et al. ..... 273/400
4,461,484 7/1984 Headrick ..... 273/400
4,792,143 12/1988 Headrick ..... 273/400
5,358,255 10/1994 Jolson ..... 273/400
5,452,903 9/1995 Larrabee ..... 273/400

*Primary Examiner*—Mark S. Graham
*Attorney, Agent, or Firm*—Daniel V. Thompson

[57] ABSTRACT

The present invention is directed to an improved disc-catching device. A member shaped as an inclined plane for purposes of attaching the chains of the disc-catching device is provided. The particular shape of the inclined plane member allows the top link of the chain to more easily slide inwardly when the chain is impacted by a disc. This arrangement allows the disc-catching device to more easily absorb the energy of the disc making it more likely that the disc will stop and drop down into a catch-basket rather than being deflected away.

3 Claims, 3 Drawing Sheets

DISC-CATCHING DEVICE

BACKGROUND OF THE INVENTION

My past inventions of Disc Golf disc-catching devices, U.S. Pat. No. 4,039,189; U.S. Pat. No. 4,461,484; and U.S. Pat. No. 4,792,143 have focused on the need to provide technology to catch the ever-improving disc design. According to many of my disc golf buddies who freely criticize my previous inventions and are even freer to point out areas of required improvement, the pendulum has swung away from heavier, faster projectiles to discs that fly, weigh less, and are easier for recreational player's to control. This presents a unique problem to disc-catching devices that must now catch a disc weighing 150 grams or less compared to 180 grams. A single piece of energy absorbing material such as a chain needs to gently absorb the forward motion of the disc, as well as the spin of the disc to avoid a rejection. As the energy of the disc moves the chain, the disc will impact at least one other piece of chain, and, more than likely, two more pieces of the outer ring of chain. If the energy of the disc exceeds the mass of outer chains, the disc will then encounter as many as two lengths of inner chain, which absorb the final energy of the disc that then drops into the basket thus completing the hole.

Another phenomenon encountered by the disc is how many links up from the bottom ring the disc impacts the chain. If the total weight of one length of the chain is 263.5 grams (21 links), each link up increases the mass by 12.6 grams; therefore, the mass of the chain increases as the disc hits higher and higher until it hits the second or third link from the top. These links have their movement restricted by the hook that the chains are attached to. As a result, a lighter disc will not have the mass sufficient to overcome the mass of the chain and will bounce out, be rejected.

Observations of discs being thrown into our catching devices have shown a distinct pattern of successful catches and rejections that indicate that discs that have a weight of 180 grams are almost always caught from three links to the bottom of the chain and rarely caught by link number two and almost never caught by the top link. Discs of 150 grams or less, unless thrown at excessive speed, often miss a catch down to link number six or seven and are generally caught down to link number ten and almost always caught by link number fourteen and always caught by the last seven links.

SUMMARY OF THE INVENTION

A solution to the problem is obvious from this observation: the top link must be free to move upon impact of a disc if possible down to link number six or seven, thus potentially opening up the sure catching area by approximately fifty percent. All of this must not permanently alter the "at rest" outer diameter of the chain holding device.

The solution may be obvious but the mechanism is certainly unobvious. Consider the top link is the heaviest. Now move it two inches out of the way, with the impact of a 150 gram disc, towards the center of the pole and then move it back to its at rest position on the periphery of the chain holder. This could be accomplished by a "swing" link several times longer than a regular link. When the link is impacted, it will swing back on the radius of the top link. Interesting, but this adds to the no catch zone above the linking point of chain to the swing link as it would not in itself catch a disc. This solution seems to be a tradeoff that increases the sure catch zone, however, it adds a substantial no catch zone.

A sliding plane link or member seems to be the answer. The ramp provides an incline plane with a mechanical advantage to the disc of approximately three to one if the angle of the plane is thirty degrees. Thus a disc of 150 grams will need to exert at least the equivalent energy of 1.5 times its weight or 225 grams to the chain to cause the top link to slide to the top of the plane. In this case, assuming the disc is moving at a velocity of seven feet per second (five M.P.H.), the kinetic energy of the disc impacting the chain will be approximately 0.33 foot pounds. More than enough to drive the chain to the top of the incline. A plane of thirty degrees also allows the chain to overcome friction with a potential energy of 225 grams, and return by sliding back to the point of origin of the incline plane which maintains the original diameter of chain holder.

BRIEF DESCRIPTION OF THE DRAWINGS

FIGS. I–V show in progression the action of a disc upon a chain of the disc catcher.

FIG. VI shows the disc catcher in its entirety.

DETAILED DESCRIPTION OF THE INVENTION

Figure 1:
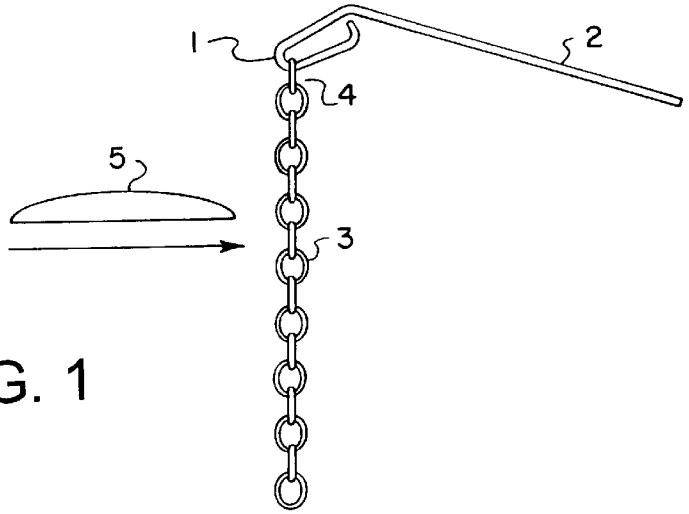
Figure 2:
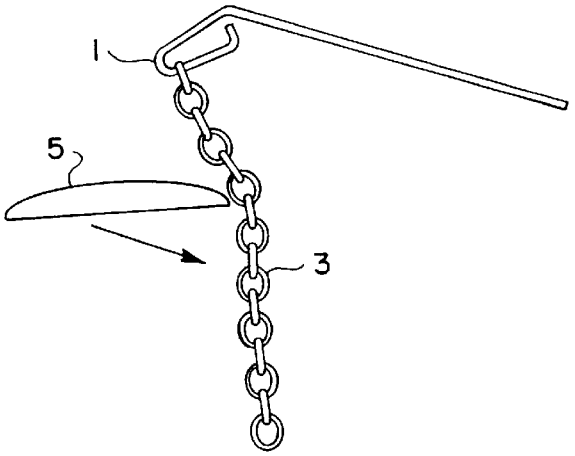
Figure 3:
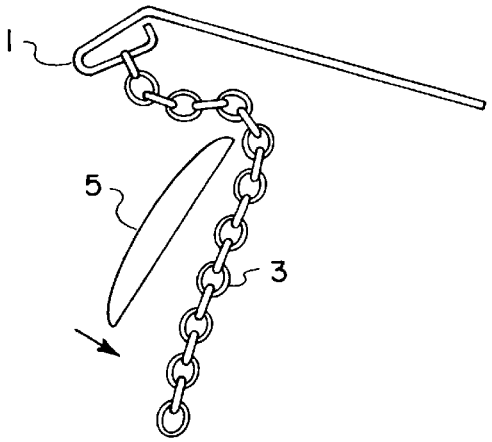
Figure 4:
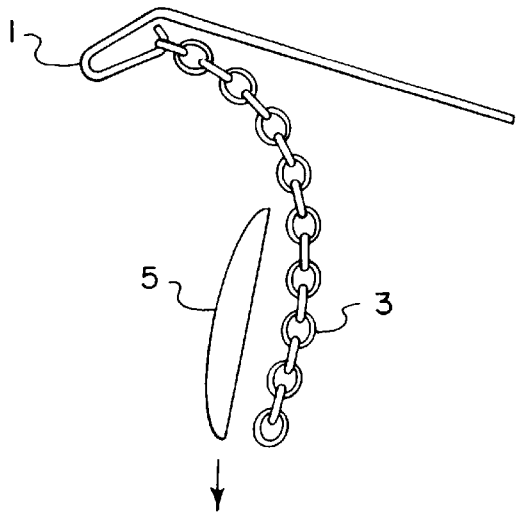
Figure 5:
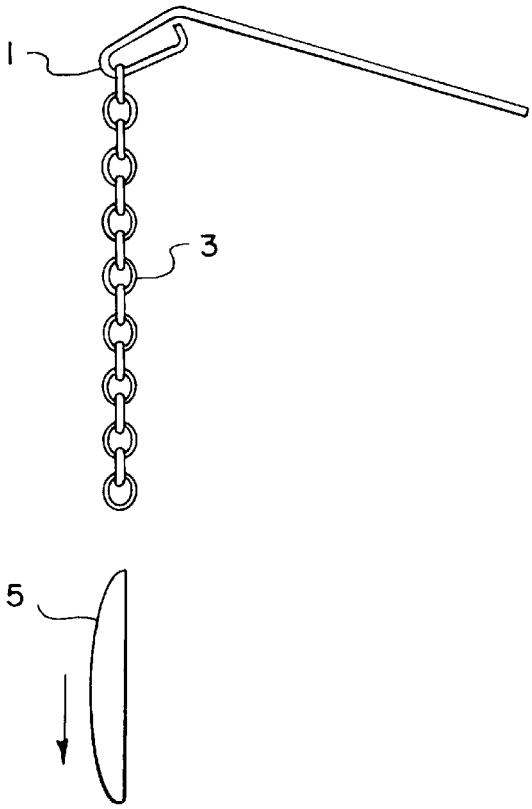
Figure 6:
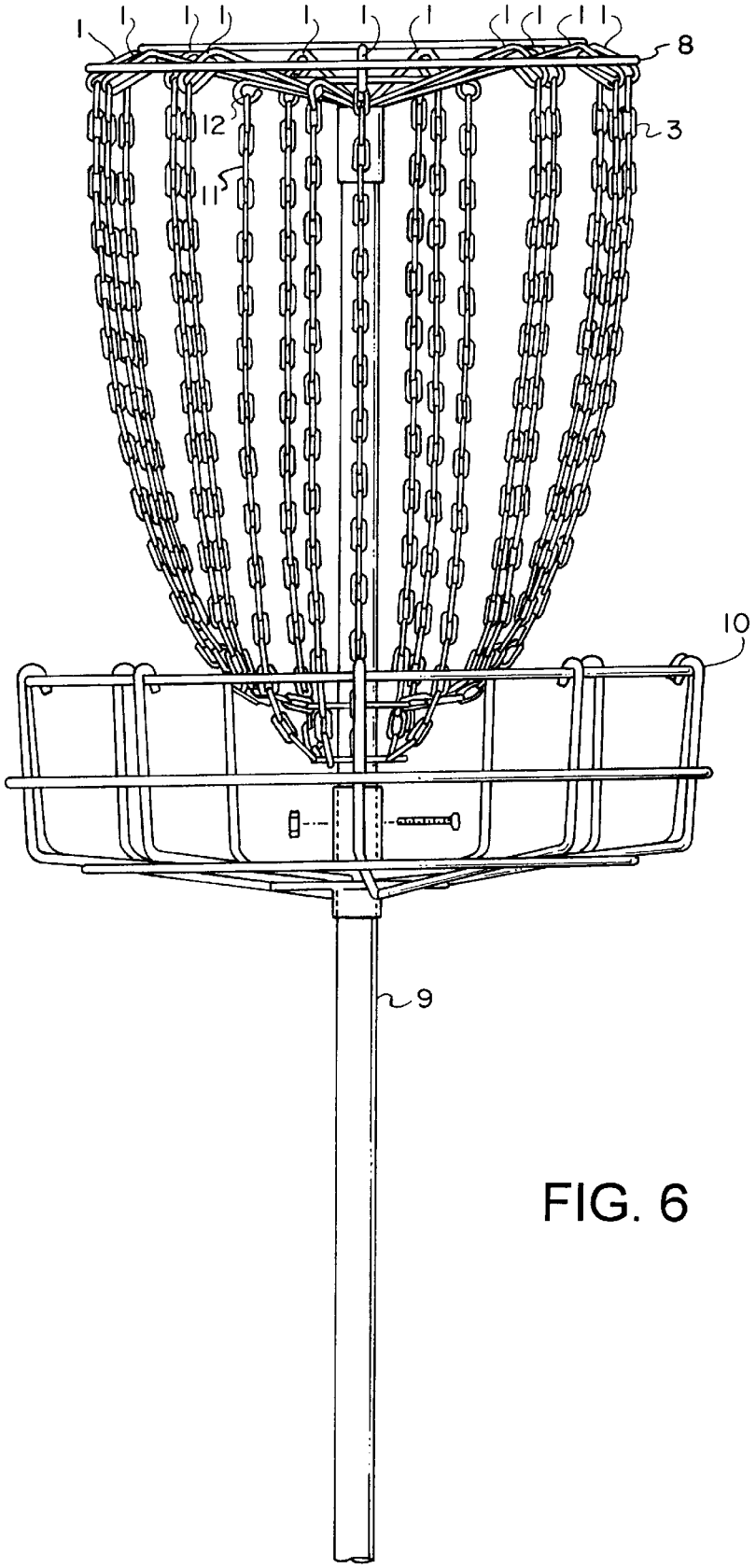

FIG. I indicates the general shape and configuration of the sliding plane link. The sliding plane link (1) itself is formed on the end of a structural rod (2) that is closed when one of the outer chains (3) is attached to it. The chain comes to rest at the low point of the sliding plane link (4) and when impacted by a disc (5), FIG. II, travels up the sliding plane link (1) to the top end of the link (FIG. IV). As the disc (5) in FIG. II strikes the chain (3) and the links react to the impact (FIG. II) the hanging chain (3) travels up the incline plane, (FIG. III & FIG. IV), and the disc #5 falls into the basket (not shown). The chain (3) then feels the full potential energy of the mass that has been raised and subsequently slides back down the incline sliding plane link to its rest position (4).

FIG. VI is a view of the preferred embodiment of the invention with its twelve sliding links (1) dispersed evenly around the periphery of the chain holder (8) which in turn support the twelve outer chains (3). The chain holder (8) is mounted on the top of the pole (9) which also supports the upward facing basket (10) that catches the disc (5) as it falls from the chains (3).

Six inner chains (11) are dispersed evenly around the pole (9) to protect from the pole (9) being struck by the disc (5) and bouncing back out. These chain(s) are supported by six or twelve hooks (12) that do not have an incline plane (1). However, it is contemplated that as the discs get lighter, it would be a simple change to install sliding planes (1) to replace hook (12) on all of my previously patented devices.

While this is the preferred embodiment, increasing the number of outer chains to eighteen or more sets of sliding plane links and chains may eliminate the need for the six or twelve inner chains.

The viewer can easily see the ease with which this device, FIG. VI can catch a disc of any weight by subtly and gracefully allowing the disc to be slowed gently to a stop and to be caught in the upward facing basket.

What I claim is:

1. In a disc-catching device having a pole, an upward facing basket fixed to the pole, a weight holder fixed to the top of the pole above the basket, and a plurality of weights hanging from the weight holder from positions dispersed evenly around the weight holder, the improvement comprising:

a sliding plane member for each weight on the weight holder;

each sliding plane member supporting a top end of one of said weights;

with each sliding plane member having a predetermined incline and length, such that a disc may strike an upper portion of a weight and have energy absorbed thereby by the travel of the weight top end up the incline, and the disc will drop into the basket, and the top end will return to its original position by gravity; and where the incline is linear, the weights are metal chains, and where the incline is about thirty degrees.

2. The device of claim 1 where the length of the sliding plane member is about two inches.

3. A disc-catching device, comprising:

a pole;

an upward facing basket fixed to the pole;

a chain holder fixed to the top of the pole above the basket;

a plurality of metal chains hanging from the chains holder from positions dispersed evenly around the chain holder;

a sliding plane member for each chain on the chain holder;

each sliding plane member supporting a top end of one of said chains;

with each sliding plane member being linear, and having an incline of about thirty degrees and length of about two inches, such that a disc may strike an upper portion of a chain and have energy absorbed thereby by the travel of the chain top end up the incline, and the disc drop into the basket, and the top end will return to its original position by gravity.

* * * * *